US006375181B1

(12) United States Patent
Kawano et al.

(10) Patent No.: US 6,375,181 B1
(45) Date of Patent: Apr. 23, 2002

(54) FINISHER AND IMAGE FORMING APPARATUS THEREWITH

(75) Inventors: Minoru Kawano; Tsuyoshi Tsuchiya; Masaru Ohtsuka, all of Hachioji; Toshitaka Matsumoto, Tokyo; Hirohiko Okabe, Tokorozawa, all of (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/534,098

(22) Filed: Mar. 23, 2000

(30) Foreign Application Priority Data

Mar. 29, 1999 (JP) ..... 11-085870

(51) Int. Cl.[7] ..... B65H 33/04
(52) U.S. Cl. ..... 270/58.12; 271/188; 271/209
(58) Field of Search ..... 271/188, 209; 270/58.12

(56) References Cited

U.S. PATENT DOCUMENTS 5,153,663 A * 10/1992 Bober et al. ..... 271/188 X
5,590,871 A * 1/1997 Okabe et al. ..... 270/58.27
5,622,359 A * 4/1997 Kawano et al. ..... 270/58.12
5,741,009 A * 4/1998 Kawano et al. ..... 271/182
5,765,824 A * 6/1998 Kawano et al. ..... 270/58.11

FOREIGN PATENT DOCUMENTS

JP 358109357 A * 6/1983
JP 403172248 A * 7/1991

* cited by examiner

*Primary Examiner*—Christopher P. Ellis
*Assistant Examiner*—Patrick Mackey
(74) *Attorney, Agent, or Firm*—Bierman, Muserlian and Lucas

(57) ABSTRACT

A finisher includes: a conveyor for conveying sheets; an intermediate stacker on which conveyed sheets are stacked; a stapler for stapling a stacked package of sheets; a sheet delivery device for delivering the stapled package of sheets; an up-and-down sheet exit tray on which the delivered package of sheets is stacked and which can move up and down; a driving device for driving the up-and-down sheet exit tray; an upper limit detector for detecting an upper limit position of a surface of the stapled package of sheets which is stacked on the up-and-down sheet exit tray; and a controller for controlling the driving device, wherein when a mode to staple a package of sheets which is not larger than a predetermined size and not larger than a predetermined number of sheets, is set, the controller temporarily withdraws the up-and-down sheet exit tray from the upper limit to a lower position before the stapled package of sheets has been delivered onto the up-and-down sheet exit tray; and when the sheet delivery device stops, the controller controls the driving device in such a manner that the up-and-down sheet exit tray is moved upward, and stopped at the upper limit position.

4 Claims, 13 Drawing Sheets

FIG. 13 ( a )
PRIOR ART
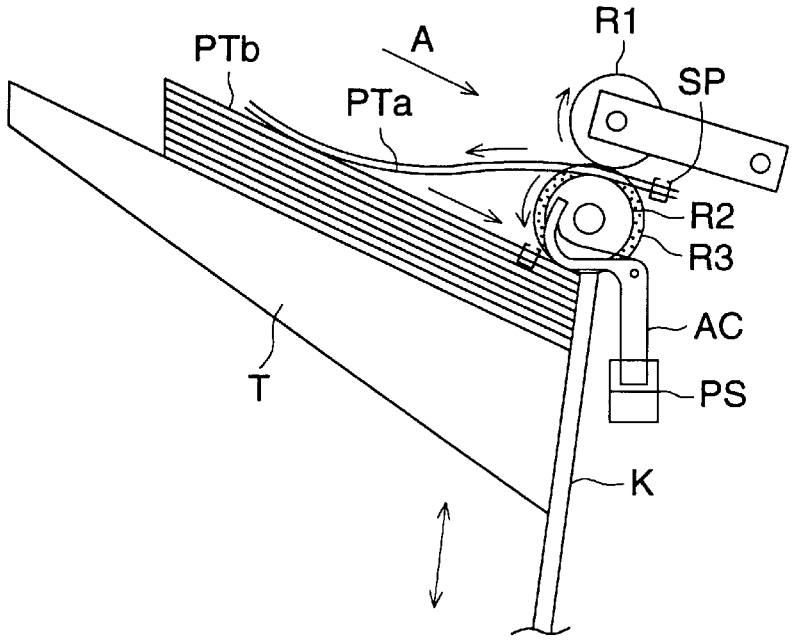
FIG. 13 ( b )
PRIOR ART
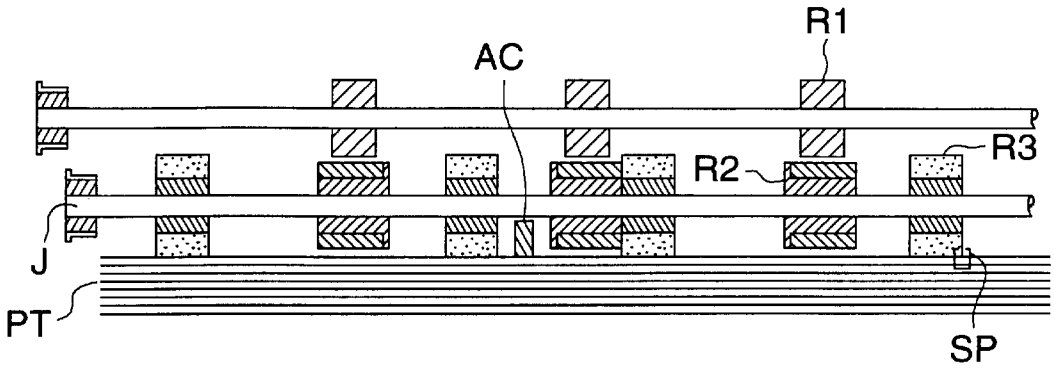

FINISHER AND IMAGE FORMING APPARATUS THEREWITH

BACKGROUND OF THE INVENTION

The present invention relates to a finisher by which an image formed sheet is received, and finishing such as stapling by a stapling means is conducted, after that, the sheets are delivered onto a sheet exit tray, in an image forming apparatus such as an electrophotographic copier, printer, facsimile device or printing machine, and to an image forming apparatus provided with the finisher.

The finisher by which a plurality of sheets, on which images are formed, delivered from the image forming apparatus main body are aligned for each number of copy s, and finishing such as stapling is conducted on the sheets by a finishing means such as a stapling means, is used.

This kind of finisher is connected in its function to the image forming apparatus main body such as a copier, printer, or facsimile device, and is driven corresponding to the sequence operation of copying or printing processes.

Accordingly, for the image forming apparatus main body which can process the image forming process at high speed, the finisher which can performs the function following to the processing speed and can conduct high speed processing, is required.

Such the finisher which can conduct high speed processing, is disclosed already in Japanese Tokkaisho No. 60-142359, No. 60-158463, No. 62-239169, and Japanese Tokkaisho No. 62-288002, No. 63-267667, Japanese Tokkaihei No. 2-276691, and Japanese Tokkohei No. 5-41991.

In the above finisher, the sheets on which images are formed, delivered from the image forming apparatus main body, are successively stacked in the intermediate stacker while being aligned, and after the sheets are accommodated as one package of sheets, finishing by the stapler is conducted on the package of sheets, and stapled package of sheets is placed on an exit belt provided on the bottom portion of the intermediate stacker and conveyed, and nipped by a pair of upper and lower sheet exit rollers and delivered onto a sheet exit tray.

In the sheet exit tray, the sheet placement surface is slantingly arranged in such a manner that the sheet rises toward the leading edge from the trailing edge, and on the back end side of the sheet exit tray, a sheet trailing edge contact reference member is formed such that it is provided vertically. When the trailing edge of the delivered sheet passes on the sheet trailing edge contact reference member, the sheet naturally falls by its self weight, and falls slidingly on the upper surface of the sheets placed on the sheet exit tray, and is brought into contact with the sheet trailing edge contact reference member, thereby, the trailing edge of the sheets is aligned in the sheet exit direction. Such the sheet stacking mechanism is written in Japanese Tokkaisho No. 57-48558.

Th finisher disclosed in Japanese Tokkaihei No. 2-233456 has the sheet exit tray which can horizontally move perpendicularly to the sheet conveyance direction, and the relative position of the sheet exit tray and the delivery position is changed depending on whether finishing is necessary for the sheets.

FIGS. 13(*a*) and 13(*b*) show a sheet delivery means of a conventional finisher, and 13(*a*) is a plan view and 13(*b*) is a side view viewed from the direction of an arrow A.

The sheet delivered from the image forming apparatus main body is guided into the finisher, conveyed, and aligning processed on the intermediate stacker; after stacked and accommodated package of sheets PTa is stapling processed by the stapling means, the package of sheets PTa is nipped by the rotating sheet exit upper roller R1 and the sheet exit lower roller R2; and its conveyance is assisted by a winding roller R3, the package of sheets PTa is delivered onto an up-and-down sheet exit tray T, and slidingly falls on the slanting surface of the up-and-down sheet exit tray T, or the upper surface of the package of sheets PTb which is already slantingly placed on the up-and-down sheet exit tray T, by the self weight of the package of sheets PTa, and brought into pressure-contact with the outer peripheral surface of the rotating winding roller R3 and conveyed, and brought into contact with a sheet trailing edge contact reference member K and stops.

The leading edge portion of an oscillatable actuator AC to on-, off-operate a sheet exit tray upper limit sensor PS is in light pressure-contact with the upper surface of the package of sheets PT stacked on the up-and-down sheet exit tray T, and corresponding to the height of the sheets stacked on the up-and-down sheet exit tray T, a control means up-and-down controls the up-and-down sheet exit tray T so that the sheet exit lower roller R2 and the upper surface of the package of sheets PT maintain a predetermined interval between them.

When the sheet is delivered one by one onto the slantingly arranged up-and-down sheet exit tray T, because it is difficult that the sheet is assuredly brought into contact with the sheet trailing edge contact reference member K and stopped, only by the self weight of the sheet, sliding contact by the rotating winding roller R3 is necessary.

When the package of sheets, in which a plurality of sheets are stapling processed, is aligned on the up-and-down sheet exit tray T, staple wires stapled onto different positions for each sheet size, come into contact with the sheet exit lower roller R2 or the winding roller R3, and thereby, there is a case that the sheet exit lower roller R2 or the winding roller R3 is shaved and damaged.

In the package of sheets stacking, while the first stapling-processed package of sheets is delivered onto the up-and-down sheet exit tray T, the up-and-down sheet exit tray T is moved below temporarily, and after the first package of sheets PT has been delivered, the up-and-down sheet exit tray T is elevated, and at the time when the sheet exit tray upper limit sensor PS detects the uppermost surface position of the package of sheets PT, the up-and-down sheet exit tray T is stopped, and stands by the sheet exit of the second package of sheets PT.

Conventionally, in the case where, after the stapling is conducted on the sheets, the package of sheets is delivered onto the up-and-down sheet exit tray by the drive of a sheet delivery means, and is brought into contact with a stopper by the winding roller R3 and aligned, when there is a time period of the conveyance interval between respective package of sheets, the up-and-down sheet exit tray is lowered at the time of alignment of the package of sheets, and there is a time margin to stop the drive of the sheet delivery means, and there is no possibility that the staple wires by which the package of sheets is stapled, are brought into contact with the sheet exit lower roller R2 or winding roller R3 and shave them.

That is, in this method, when a large sized sheet (for example, A4R, B4, A3, etc.) or a large number of sheets (for example, more than 3) are stapled, because there is a sufficient time period of the conveyance interval between the first package of sheets and the second package of sheets at the delivery, the up-and-down movement of the up-and-down sheet exit tray T can be conducted.

However, when small sized sheets (for example, A4, B5 sheets) and a small number of sheets (for example, not more than 2 sheets) are stapled, and delivered onto the up-and-down sheet exit tray T by the sheet delivery means and brought into contact with the stopper and aligned, because a time period of the conveyance interval between the first package of sheets and the second package of sheets is greatly small, the drive of the sheet delivery means having the sheet exit upper roller R1 and the sheet exit lower roller R2, and the winding roller R3, is not stopped and the sheet delivery means continues driving-rotation, therefore, the above up-and-down movement of the up-and-down sheet exit tray T can not be applied to it. Therefore, a problem occurs that the staple wires of the stapled package of sheets moving downward on the up-and-down sheet exit tray T shave the surface of the rotating delivery sheet lower roller R2 or winding roller R3, and damage them.

In order to solve the above problems, when the up-and-down sheet exit tray T is lowered from the first, and a predetermined interval is set large, because the interval of the contact pressure position of the sheet exit upper roller R1 and the sheet exit lower roller R2, and the up-and-down sheet exit tray T or the upper surface of the package of sheets stacked on the up-and-down sheet exit tray T, becomes large, the leading edge portion of the package of sheets delivered from the nip position of the sheet exit upper roller R1 and the sheet exit lower roller R2 comes to contact with the up-and-down sheet exit tray T or the upper surface of the package of sheets stacked on the up-and-down sheet exit tray T, and a problem that, as shown in FIG. 13(*a*), the sheet exit can not be smoothly conducted, is generated.

SUMMARY OF THE INVENTION

An object of the present invention is to solve the above problems and to provide a finisher by which, when small sized sheets and small number of sheets are stapled, the prevention of the shaving onto the sheet exit lower roller or the winding roller by the staple wires of the package of sheets, and the control of the upper limit height detection of the up-and-down sheet exit tray for each delivery of one package of sheets, can stand together, and an image forming apparatus provided with the finisher.

(1) The above object can be attained by a finisher, which comprising: a conveyance means for conveying sheets; an intermediate stacker on which conveyed sheets are stacked; a stapling means for stapling a stacked package of sheets; a sheet delivery means for delivering the stapled package of sheets; an up-and-down sheet exit tray on which the delivered package of sheets is stacked and which can move up and down; a driving means for driving the up-and-down sheet exit tray; a detection means for detecting the upper limit position of the uppermost surface of the stapled package of sheets which is stacked on the up-and-down sheet exit tray; and a control means, the finisher being characterized in that: when a mode to staple a package of sheets which is not larger than a predetermined size and not larger than a predetermined number of sheets, is set, the control means temporarily withdraws the up-and-down sheet exit tray from the upper limit to the lower position before the stapled package of sheets has been delivered onto the up-and-down sheet exit tray; and when the drive of the sheet delivery means stops, the control means controls the driving means in such a manner that the up-and-down sheet exit tray is moved upward, and stopped at the upper limit position.

(2) Further, the above object can be attained by an image forming apparatus comprising the finisher described in (1).

BRIEF DESCRIPTION OF THE DRAWINGS

FIGS. 13(*a*) and 13(*b*) are a plan view of the sheet delivery means of the conventional finisher, and a side view viewed from an arrow A.

DETAILED DESCRIPTION OF THE PREFERRED EMBODIMENT

Next, an embodiment of a finisher of the present invention will be described according to attached drawings.

Figure 1:
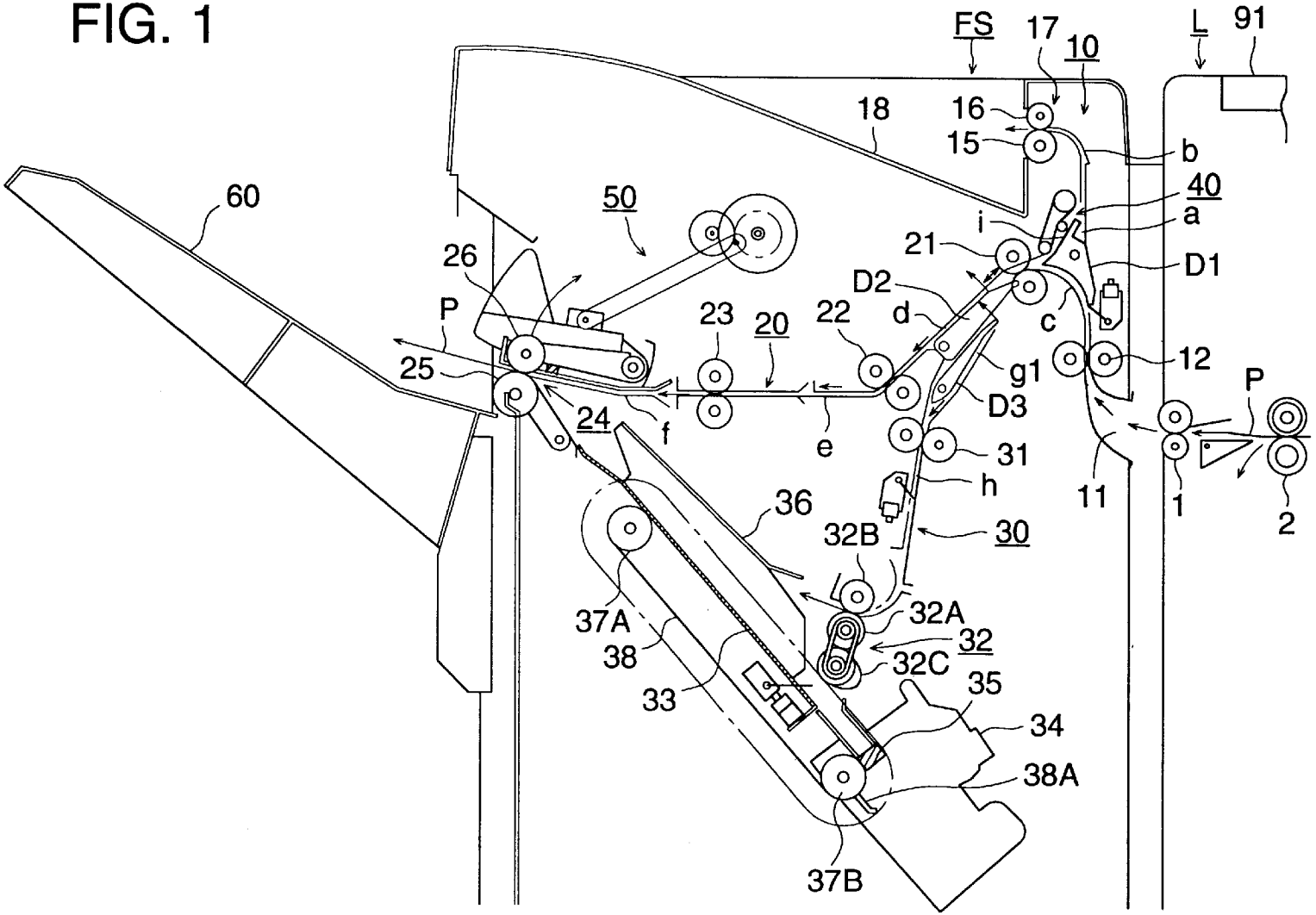
FIG. 1 is a sectional view showing a structure of a finisher.
Figure 2:
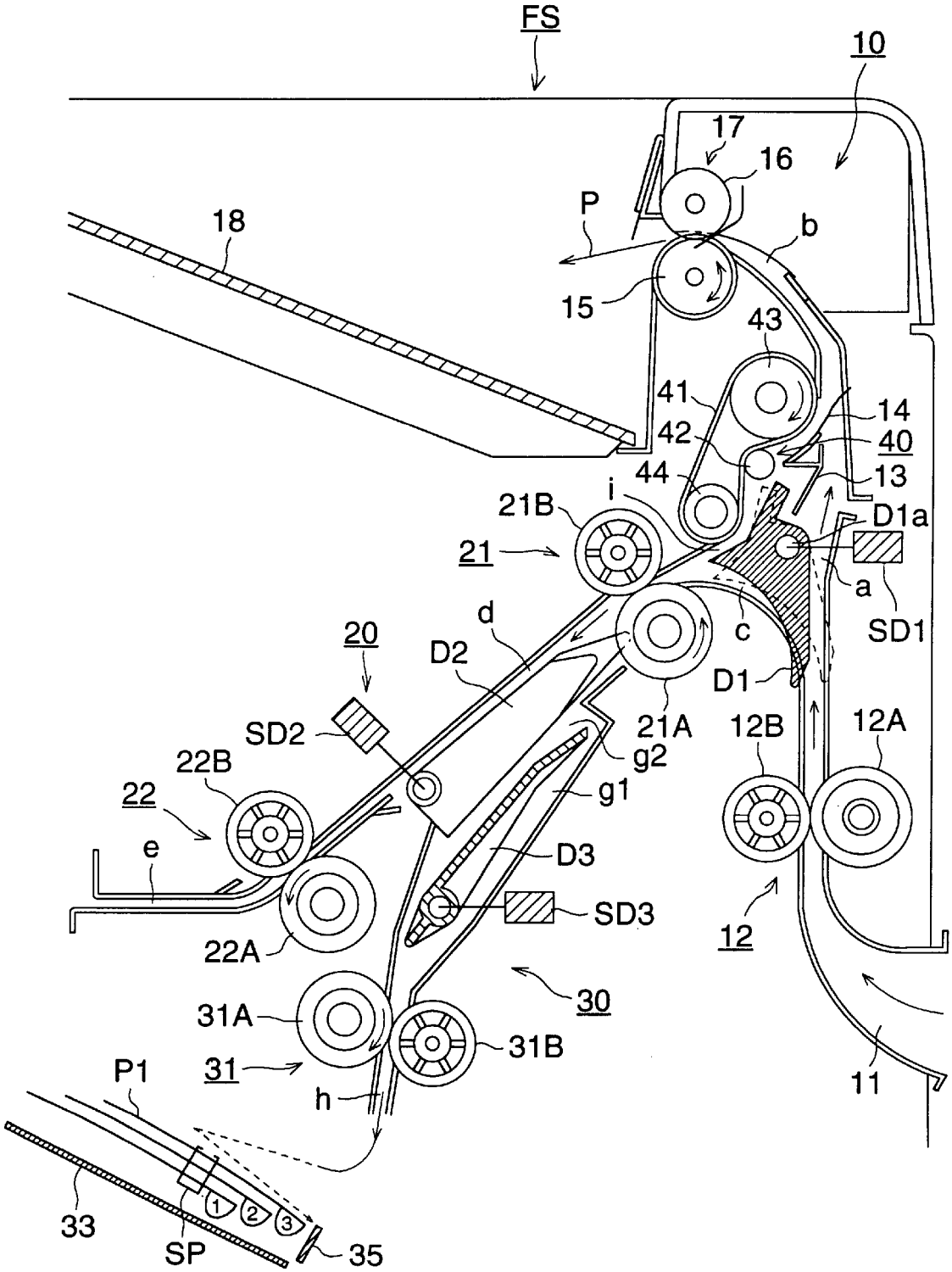
FIG. 2 is a sectional view of a conveyance means of the finisher.

FIG. 1 is a sectional view showing a structure of a finisher FS, and FIG. 2 is a sectional view of a conveyance means of the finisher FS by which sheets delivered from an image forming apparatus main body L are received and conveyed to an up-and-down sheet exit tray (or a fixed sheet exit tray).

The finisher is adjusted to the position and height such that a receiving portion of a sheet P coincides with a sheet delivery means 1 of the main body of an image forming apparatus (for example, a copier, printer, facsimile device, etc.) L, and is installed. Further, the conveyance means of the finisher is controlled by a control means so that it is driven corresponding to operations of the image forming apparatus main body L.

An image on the sheet P, on whose one side surface or two-side surfaces images are formed in an image forming section in the image forming apparatus main body L, is fixed by a fixing device 2, and after the sheet P is delivered outside the apparatus main body by a main body sheet exit means 1, the sheet P is conveyed into a receiving section 11 of the finisher FS.

The conveyance path of the sheet P, connected to the downstream of the sheet conveyance of an inlet section roller 12 composed of a driving roller 12A and a follower roller 12B in the receiving section 11, is branched into 3 routes of the first conveyance path 10 on the upper stage, the second conveyance path 20 on the middle stage, and the third conveyance path 30 on the lower stage, and the sheet P is supplied to any one of the conveyance paths by the selection of an angle of the switching gates D1, D2 and D3.

(1) The first conveyance path 10 (the conveyance path used when the sheet is delivered onto the fixed sheet exit tray in the upper portion of the finisher at the time of non-staple and non-sort.)

The image formed sheet P delivered from the image forming apparatus main body L is conveyed into a receiving section 11, conveyed by an inlet section roller 12, passes the path "a" on the right hand of an upper first switching gate D1, opens a leading edge portion of a flexible member 14 held by a holding member 13, advances and moves upwardly, further, passes an upper path "b", nipped by a delivery roller 17 composed of a driving roller 15 and a follower roller 16, delivered onto a fixed sheet exit tray 18 in an upper portion of the finisher, and stacked (straight sheet exit).

In this fixed sheet exit tray 18, the sheets P of maximum about 50 sheets can be accommodated, and the sheets P can be easily taken out of the upper portion of the finisher FS.

(2) The second conveyance path 20 (the conveyance path used when the sheets are delivered onto the up-and-down sheet exit tray 60 at the time of non-sort, non-staple and offset)

When the above conditions are set by an input from an operation section of the image forming apparatus, the switching gate D1 is oscillated around a shaft D1a by the drive of a solenoid SD1, stops at a dotted line position shown in FIG. 2, closes the path "a", and makes a path "c" an opened condition.

The image formed sheet P delivered from the image forming apparatus main body L is conveyed into the receiving section 11, conveyed by the inlet section roller 12, passes the path "c " formed in an opened condition on the lower side of the switching gate D1, nipped by a conveyance roller 21 composed of a driving roller 21A and a follower roller 21B, passes a path "d" on the upper side of the second switching gate D2 which is at a slant lower portion, nipped by a conveyance roller 22 composed of a driving roller 22A and a follower roller 22B, through a path "e", nipped by a conveyance roller (shift roller) 23, through a path "f", and delivered onto the up-and-down sheet exit tray 60, provided outside the apparatus, with its image surface facing upward, by a sheet exit roller unit 24 composed of a lower roller unit 25 and an upper roller unit 26, and placed. Numeral 50 is an oscillation means, which will be described alter, for oscillating the upper roller unit 26, and a portion of the structure of the sheet delivery means.

This up-and-down sheet exit tray 60 can move up and down, and the sheets P of maximum about 2000 sheets can be stacked on it.

(3) The third conveyance path 30 (the conveyance path used when the sheets are delivered onto the up-and-down sheet exit tray 60 at the time of stapling)

The sheet P which is image-formed thereon in the image forming apparatus main body L and conveyed into the receiving section 11 of the finisher FS, is conveyed by the inlet section roller 12, passes the path "c" on the lower side of the first switching gate D1, and is nipped by a conveyance roller 21, passes a path "g1" on the lower side of the third switching gate D3, and is nipped by a conveyance roller pair 31 composed of a driving roller 31A and a follower roller 31B, and conveyed.

The sheet P which is nipped by a conveyance roller pair 32 (which is also called register roller pair) composed of a driving roller 32A and a follower roller 32B, and conveyed, is delivered in the upper space of an intermediate stacker 33 which is slantingly arranged. After the sheet P comes into contact with the intermediate stacker 33 or the upper surface of the sheets P stacked on the intermediate stacker 33 and is slidingly moved upward, and the trailing edge of the sheet P is delivered from the conveyance roller 32, the sheet P is turned to move down by the self weight of the sheet P, and slides down on the slant surface of the intermediate stacker 33, and the trailing edge of the sheet P is brought into contact with a sheet contact member (stopper)35 in the vicinity of a stapler 34 constituting the stapling means and stopped.

Numeral 36 is a pair of alignment members provided movably on both side surfaces of the intermediate stacker 33. The alignment member 36 can move in the direction perpendicular to the sheet conveyance direction, and at the time of sheet reception in which the sheet P is delivered onto the intermediate stacker 33, the alignment members are opened more widely than the sheet width, and when the sheet P slides down on the intermediate stacker 33 and is brought into contact with a stopper 35 and stopped, the alignment members tap side edges in the width direction of the sheets P and align the width of the package of sheets (alignment). At this stopped position, when a predetermined number of sheets P are stacked and aligned on the intermediate stacker 33, stapling is conducted by staple wires SP struck out from the stapler 34, and the package of sheets is stapled.

A cutout portion is formed on a portion of the sheet placement surface of the intermediate stacker 33, and a plurality of exit belts 38 wound around a driving pulley 37A and a driven pulley 37B are rotatably driven. On a portion of an exit belt 38, a delivery claw 38a is integrally formed, and its leading edge portion draws an elliptic locus as shown by a one dotted chain line in the drawing. The stapled package of sheets P whose trailing edge is held by the delivery craw 38*a* of the exit belt 38, is placed on the exit belt 38, slides on the placement surface of the intermediate stacker 33, and is moved toward upper slant portion, and advances to a nip position of the sheet exit roller unit 24. The package of sheets nipped by a rotating sheet exit roller 26 and a sheet exit roller 25 is delivered onto the up-and-down sheet exit tray 60 with the image surface facing upward, and placed.

(4) The fourth conveyance path 40 (the conveyance path used when the sheet is reversal-conveyed)

In the first conveyance process, the first switching gate D1 is held in the condition as shown in the drawing by the solenoid SD1, and opens the path "a". The leading edge portion of the sheet P which is fixing-processed by the fixing device 2 of the image forming apparatus main body L and delivered by the main body sheet exit means 1, and on which the image is formed, is nipped and conveyed by the inlet portion roller 12 which is normally driven, passes the path "a" on the right side of the upper first switching gate D1, opens the leading edge portion of the flexible member 14 held by the holding member 13, advances and moves upward, further passes the upper path "b", and is nipped by the delivery roller 17 composed of the normally rotated driving roller 15 and the follower roller 16, delivered above the fixed sheet exit tray 18 in the upper portion of the finisher, and is stopped once. At this stoppage time, the trailing edge of the sheet P is nipped by the delivery roller 17 and positioned in the path "b".

In the second conveyance process, the first switching gate D1 is oscillated by the solenoid SD1 and held in the condition shown in the drawing, and holds the path "d" in the opened condition. The trailing edge of the sheet P is nipped by the delivery roller 17 which is switched to the reversal rotation, and conveyed in the reversal direction to the regular conveyance in the path "b", passes the back surface of the flexible member 14 which is self-returned by the elasticity, and enters the pressure-contact and nip position of a conveyance belt 41 and a pressure roller 42 which are a curl correction means provided on the fourth conveyance path 40. The conveyance belt 41 is trained around a driving roller 43 and a follower roller 44, and is rotated.

When the sheet P passes the pressure-contact and nip position of the conveyance belt 41 and the pressure roller 42, a curl of the reverse direction to the curl formed on the sheet P by the image forming apparatus main body L, is applied, thereby, the correction of the curl is conducted.

The leading edge portion of the sheet P which is curl-corrected at the pressure-contact and nip position of the curl correction means, passes a path "i" on the downstream of the conveyance, and is nipped and conveyed by the conveyance roller 21, and conveyed to the path "d" of the second conveyance path 20 or a path "g1" or path "g2" of the third conveyance path 30.

Next, in the above description, for example, in order to subject to stapling, the sheet P is delivered onto the up-and-down sheet exit tray 60 through the third conveyance path 30. After the trailing edge of the sheet P is delivered through the paths "a" and "b", the sheet P is reversely conveyed by the switching of normal-to-reversal rotation of the delivery roller 17, curl-corrected by the curl correction means in the path "i", further passes the conveyance roller 21, path "g", conveyance roller 31, and further conveyed onto the intermediate stacker 33, which is slantingly arranged, by the conveyance roller 32 shown in FIG. 1. On the intermediate stacker 33, pages of the sheets are aligned as shown in the drawing, with the first image surface facing downward.

The package of sheets P positioned on the intermediate stacker 33 is stapled by the stapler 34, and the package of sheets are stapled.

Figure 3:
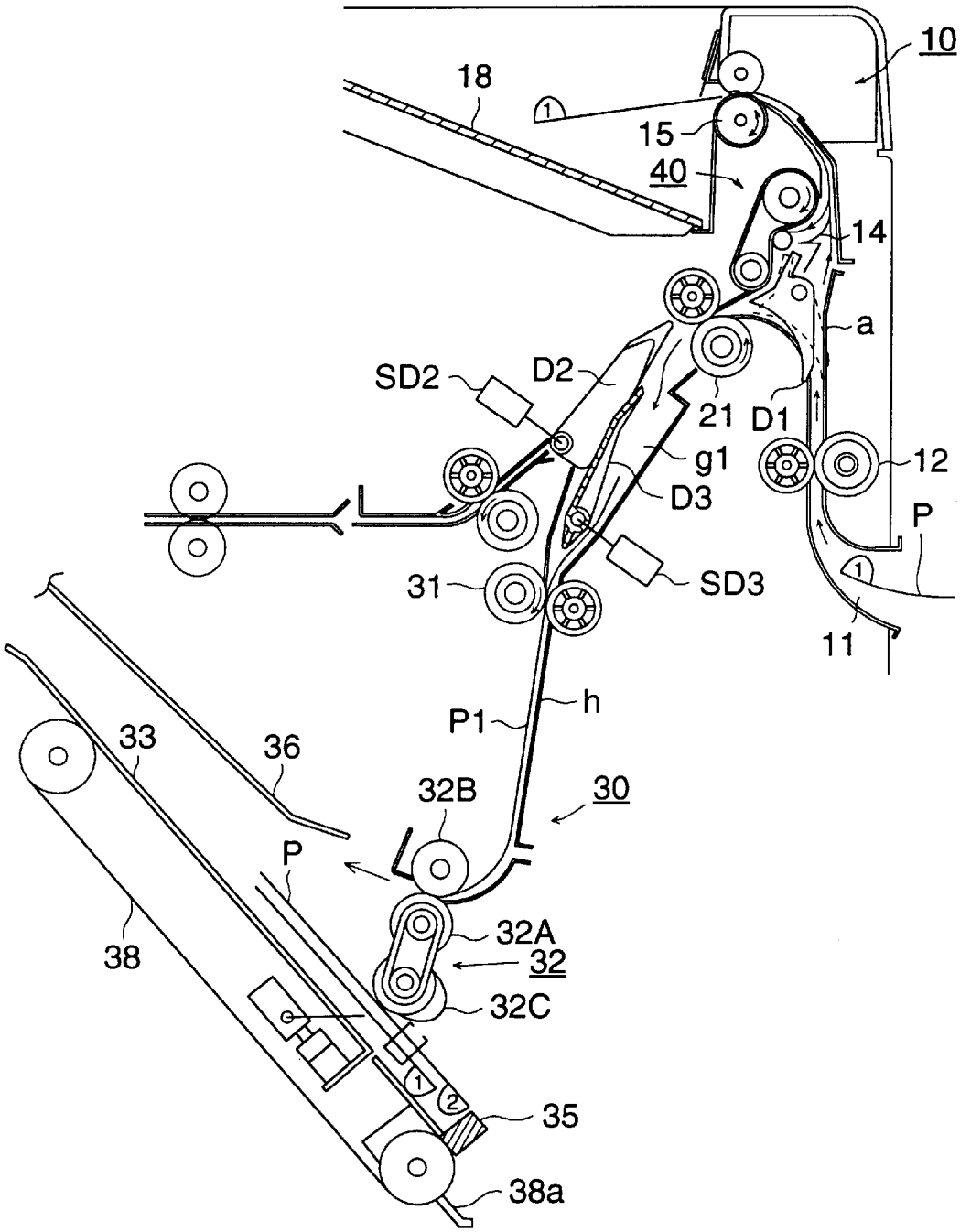
FIG. 3 is a sectional view showing a condition that the first sheet passes the path of the third conveyance path.

FIG. 3 is a sectional view showing a condition that the first sheet P1 passes the third conveyance path 30.

When the sheets are packaged and stapled, the solenoid SD2 is operated and moves the switching gate D2 upward, and blocks the path "d". Next, the solenoid SD3 is operated and moves the switching gate D3 upward, blocks the path "g2", and opens the path "g1" and the sheet P1 is made passable.

The sheet P1 nipped by the conveyance roller 21 and sent to the path "g1", passes the path "g1", and is nipped by the conveyance roller 31 and passes the path "h", and the leading edge portion of the sheet P is brought into contact with the outer peripheral surface of the roller in the vicinity of the nip position of the driving roller 32A and the follower roller 32B of the conveyance roller (register roller) 32 which is in the stopped condition, and stops. Incidentally, the trailing edge portion of the sheet P1 is in the path "g1", and the interference with the leading edge portion of the subsequent sheet P2 is prevented.

Before the subsequent second sheet P2 passes the conveyance roller 21, the solenoid SD3 is operated and oscillates the leading edge of the switching gate D3 downward, blocks the path "g1", opens the path "g2" and the sheet P2 is made passable.

Figure 4:
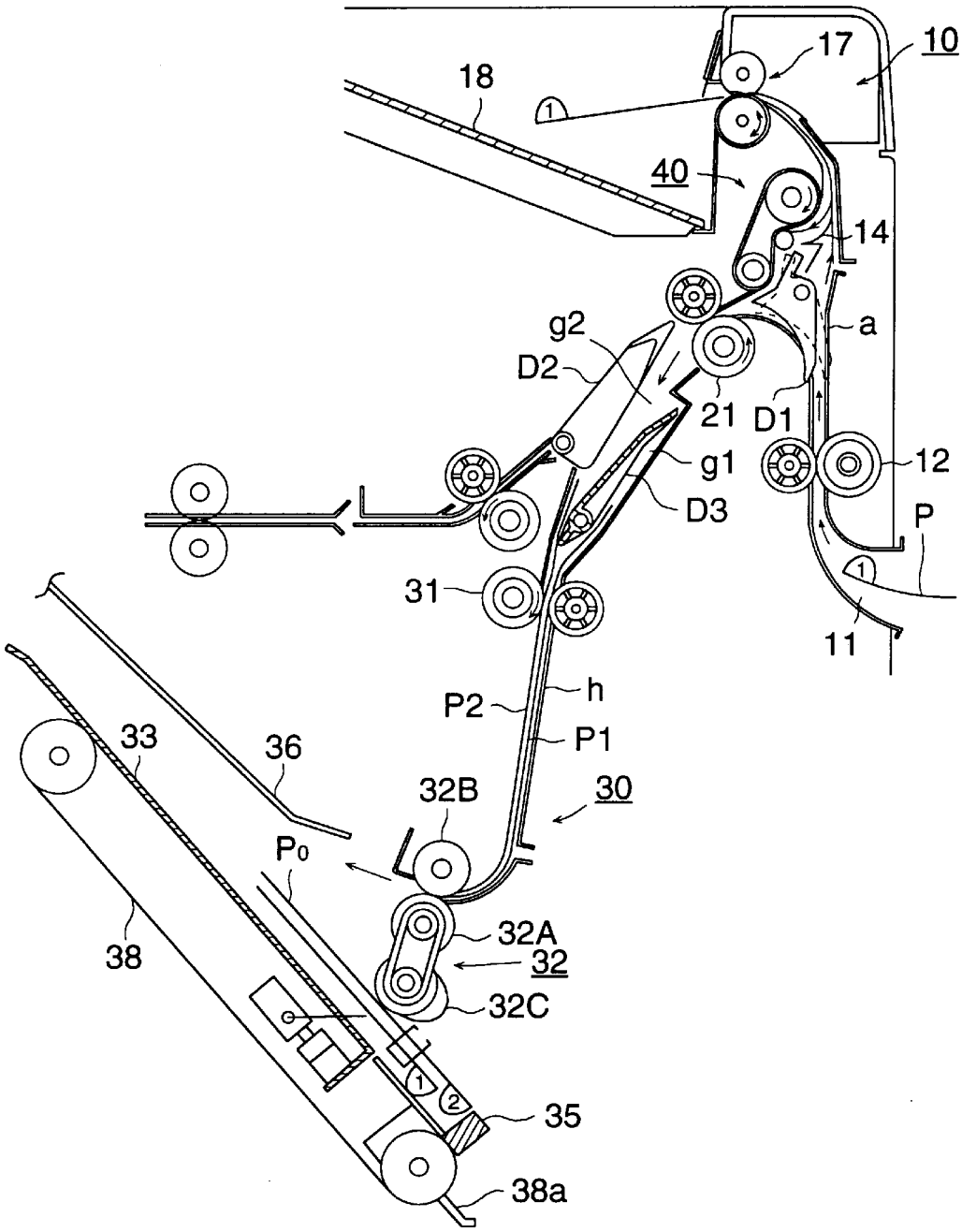
FIG. 4 is a sectional view showing a condition that the second sheet passes the path of the third conveyance path.

FIG. 4 is a sectional view showing a condition that the second sheet P2 passes the path of the third conveyance path 30.

The sheet P2 passes the path "g2", and is nipped by the conveyance roller 32 and passes a path "h", and the leading edge portion of the sheet is brought into contact with the outer peripheral surface of the roller in the vicinity of the nip position of the driving roller 32A and the follower roller 32B of the conveyance roller 32 which is in the stopped condition, and stops. Accordingly, the sheets P1 and P2 are accommodated in the condition that these are overlapped with each other, in the path "h", and each leading edge portion of the sheets P1 and P2 is in contact with the outer peripheral surface of the roller of the conveyance roller 32, and stopped.

After the preceding package of sheets $P_0$ which is stapled on the intermediate stacker 33, is delivered by an exit belt 38, the sheets P1 and P2, which are the subsequent package of sheets, are simultaneously nipped by the conveyance roller 32 under the condition that these are overlapped with each other, and are delivered onto the intermediate stacker 33.

Figure 5:
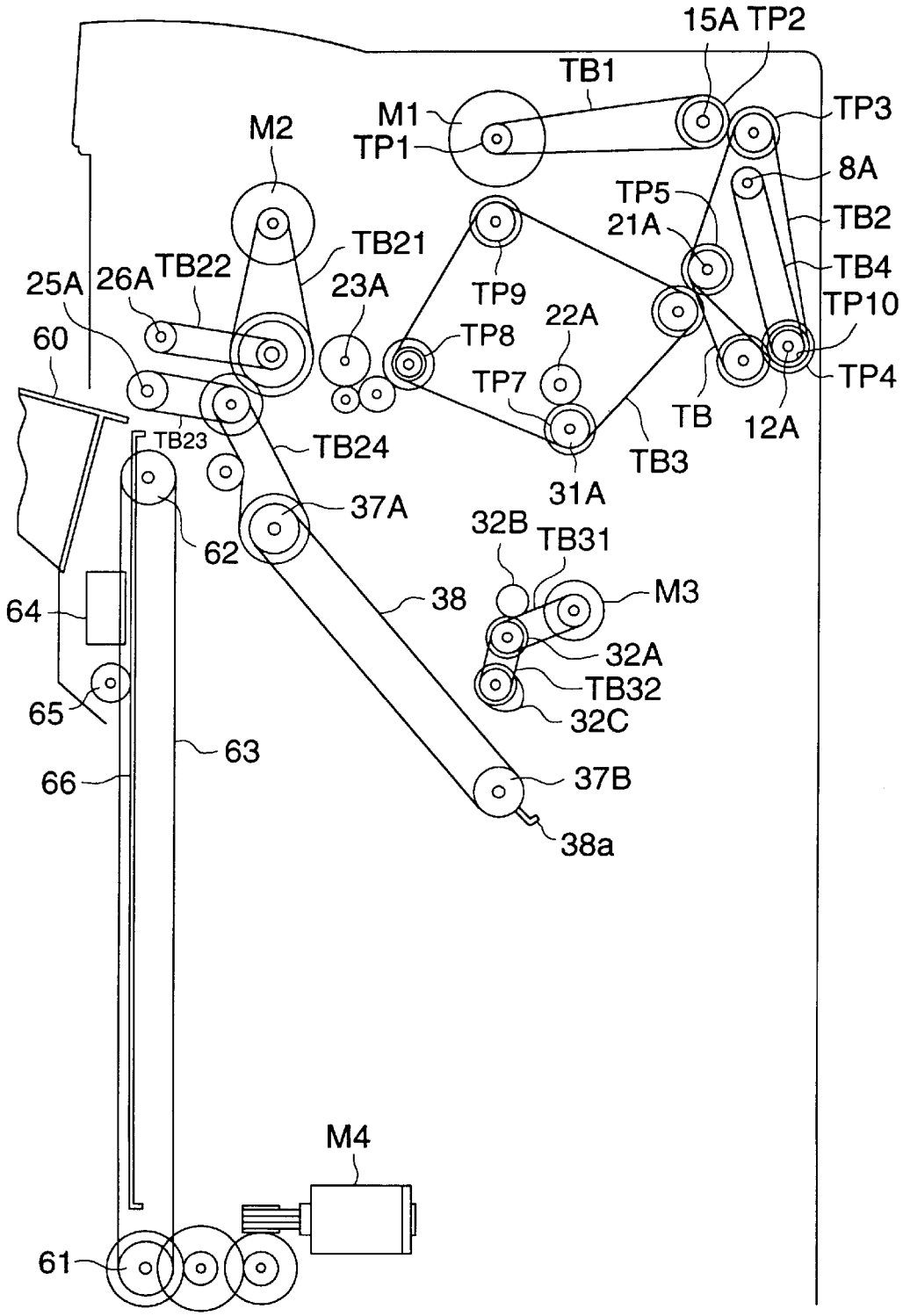
FIG. 5 is a structural view showing a driving means of the finisher.
Figure 6:
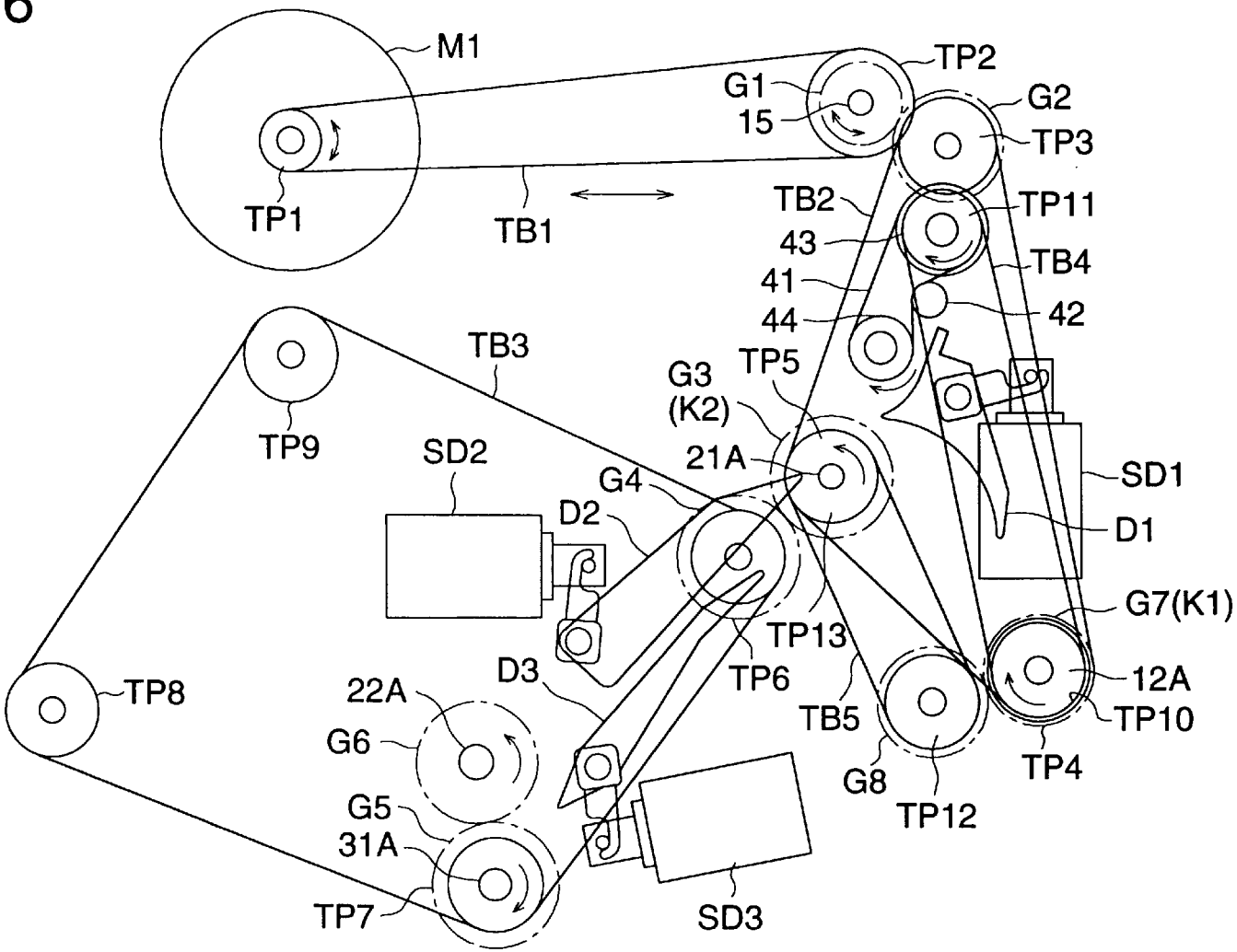
FIG. 6 is a partially detailed structural view of the driving means.

FIG. 5 is a structural view showing a driving means of the finisher, and FIG. 6 is a partially detailed structural view of the driving means.

A timing pulley TP1 fixed on a driving shaft of a driving motor M1 rotates, through a timing belt TB1, a timing pulley TP2 fixed on the rotation shaft of the driving roller 15 of the delivery roller 17. A gear G1 fixed on the rotation shaft 15 of the timing pulley TP2 is engaged with the gear G2 on an intermediate shaft. A timing belt TB2 wound around a timing pulley TP3 fixed on co-axis of the gear G2, rotates a timing pulley TP4, which is coaxial with the driving roller 12A of the inlet section roller 12, and a timing pulley TP5, which is coaxial with the driving roller 21A of the conveyance roller 21.

A gear G3 which is coaxial with a timing pulley TP5, engages with a gear G4 rotatably supported by the intermediate shaft. A timing belt TB3 wound around a timing pulley TB6 which is coaxial with a gear G4, rotates timing pulleys TP7, TP8 and TP9. The driving roller 31A of the conveyance roller 31 and a gear G5 are fixed on a co-axis of the timing pulley TP7, and integrally rotated. A gear G6 engaged with the gear G5 is rotated integrally with the driving roller 22A of the conveyance roller 22 fixed on the co-axis.

A timing pulley TP8 rotates the driving roller 23A of the conveyance roller (shift roller) 23 through a gear train shown in FIG. 5.

A timing pulley TP10 is fixed on the co-axis with the driving roller 12A of the inlet section roller 12. A timing belt TB4 wound around the timing pulley TP10 rotates a timing pulley TP11 on the above. On the shaft of the timing pulley TP11, a driving roller 43 of the curl correction means is fixed, and integrally rotated.

The curl correction means comprises the driving roller 43, a follower roller 44, conveyance belt 41 wound around the driving roller 43 and the follower roller 44, and a pressure roller to press a portion of the outer periphery of the conveyance belt 41 at the middle position between the driving roller 43 and the follower roller 44. The timing belt TB4 is rotated by the rotation of the driving roller 12A of the inlet section roller 12, and further, the conveyance belt 41 is rotated.

An one-way clutch K1 and a gear G7 are integrally fixed on the co-axis with the driving roller 12A of the inlet section roller 12. The gear G7 engages with a gear G8. The timing belt TB5 wound around a timing pulley TP12 which is coaxial with the gear G8, rotates a timing pulley TP13 which is coaxial with the timing pulley TP5. An one-way clutch K2 is attached on the shaft of the driving roller 21A of the conveyance roller 21 on the co-axis with the timing belt TP13.

At the time of the forward rotation of the driving motor M1, any one of the driving roller 12A of the inlet section roller 12, driving roller 15 of the delivery roller 17, driving roller 21A of the conveyance roller 21, driving roller 22A of the conveyance roller pair 22, driving roller 23A of the conveyance roller 23, and driving roller 43 of the curl correction means, is rotated forward, and conveys the sheet P in a predetermined direction.

At the time of the reversal rotation of the driving motor M1, only the driving roller 15 of the delivery roller 17 is reversely rotated, however, the reversal rotation is prevented by the one-way clutch K1 attached to the driving roller 12A of the inlet section roller 12, and the driving roller 43 of the curl correction means is rotated forward. Further, by the one-way clutch K2 provided on the driving roller 21A of the conveyance roller 21, the reversal rotation is prevented, and the conveyance rollers 21, 22 and 23 are also rotated forward.

The solenoid SD1 drives the switching gate D1 oscillatably, the solenoid SD2 drives the switching gate D2 oscillatably, and the solenoid SD3 drives the switching gate D3 oscillatably, and switch the conveyance paths of the sheet P.

A driving motor M2 rotates an upper roller unit 26 of a delivery roller unit 24 through timing belts TB21 and TB22, and rotates a lower roller unit 25 through a gear train and a timing belt TB23. Further, an intermediate pulley to drive the lower roller unit 25, rotates the driving pulley 37A through a timing belt TB24, and rotates a delivery belt 38.

A driving motor M3 rotates a driving roller 32A of a conveyance roller 32 through a timing belt TB31. A follower roller 32B pressure-contacts with the driving roller 32A and is rotated, and nips the sheet P and conveys it. The driving roller 32A rotates a conveyance assist rotation member (winding member) 32C through a timing belt TB32.

A driving motor M4 rotates a driving pulley 61 through a gear train, and rotates a wire 63 wound around the driving pulley 61 and upper driven pulley 62. On one portion of the wire 63, a base portion of the up-and-down sheet exit tray 60 is fixed by an engagement member 64. The up-and-down sheet exit tray 60 can move up and down along a rail member 66 when a roller 65 rotatably supported by the base portion slides on the rail member 66 and the wire 63 is rotated.

Figure 7:
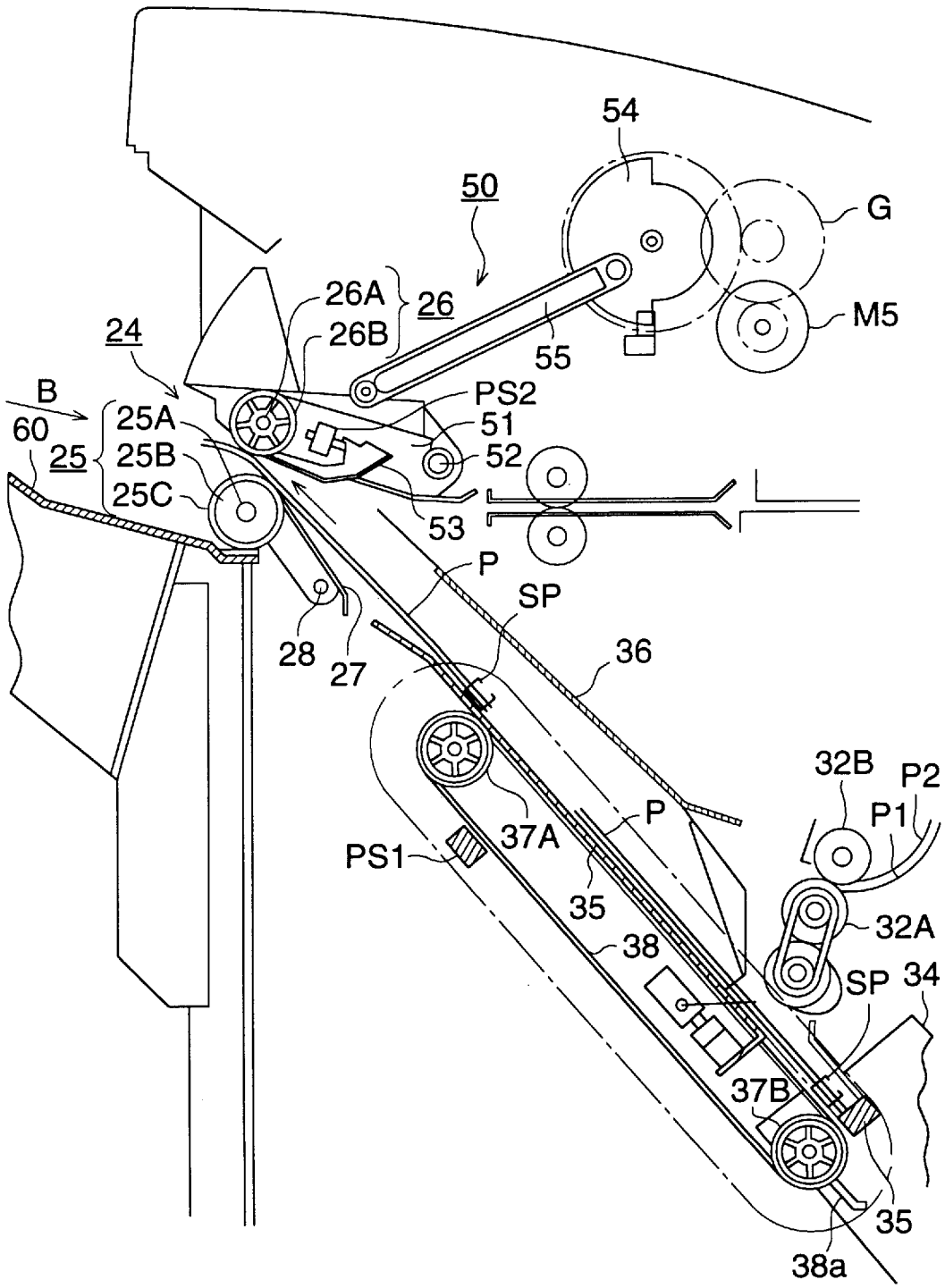
FIG. 7 is a sectional view showing a condition that the sheets are delivered from a sheet exit roller unit after being stapled.
Figure 8:
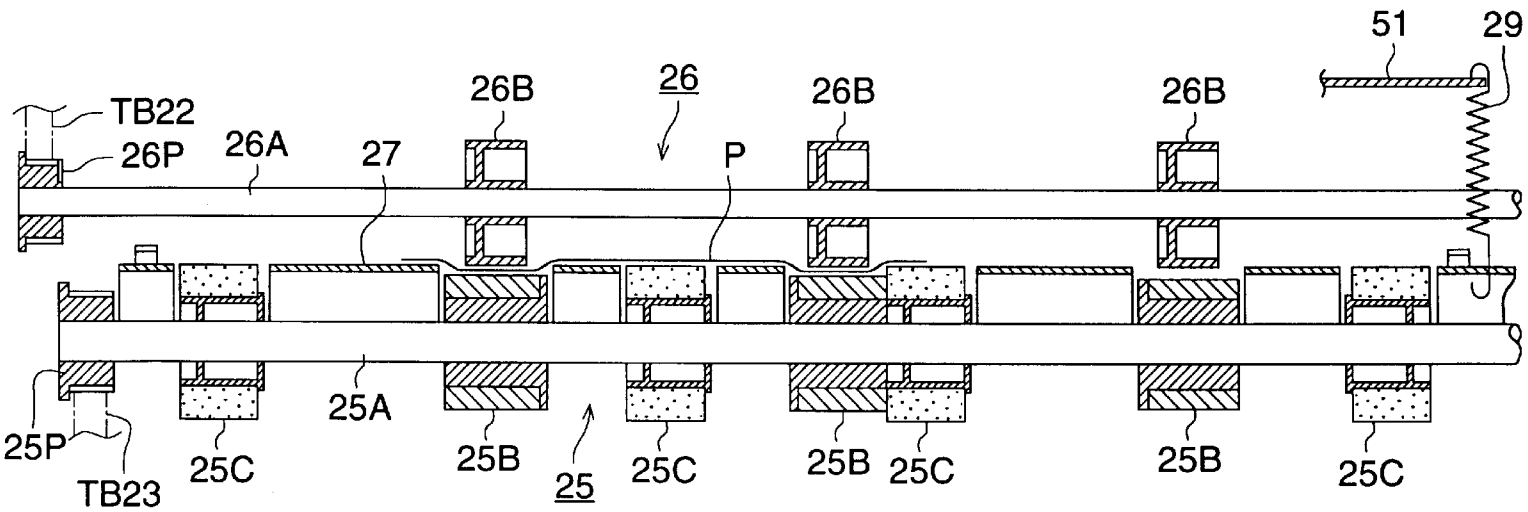
FIG. 8 is a sectional view viewed from an arrow B of the sheet exit roller unit in FIG. 7.

FIG. 7 is a sectional view showing a condition that the sheets P are delivered from the delivery roller unit 24 after the sheets P are stapled. FIG. 8 is a sectional view viewed from an arrow B of the delivery roller unit 24 in FIG. 7.

The lower roller unit 25 is composed of a rotation shaft 25A which is rotatably supported by both side walls of the finisher and on one shaft end, a timing pulley 25P is fixed, a plurality of sheet exit lower rollers 25B which have rubber layers on peripheral surfaces, a plurality of winding rollers 25C which have flexible sponge layers on the peripheral surfaces, and a timing pulley 25P, and is rotated by the motor M2 through a timing belt TB23 wound around the timing pulley 25P.

One sheet exit guide plate 27 is supported oscillatably around a support shaft 28 at an intermediate portion of the plurality of sheet exit lower rollers 25B and the plurality of winding rollers 25C. The sheet exit guide plate 27 is pulled upward by a elastic member 29 stretched between an oscillation means 50, and is brought into contact with the stopper through a buffer material. At this contact time, the upper surface of the sheet exit guide plate 27 protrudes upward from the outer peripheral surface of the winding roller 25C.

The upper roller unit 26 is composed of a rotation shaft 26A, a plurality of sheet exit upper rollers 26B, and a timing pulley 26P, and is rotated by the motor M2 through the timing belt TB22 wound around the timing pulley 26P.

Both shaft ends of the rotation shaft 26A are rotatably supported by a holding member 51 of the oscillation means 50. The holding member 51 is oscillatably supported around a support shaft 52. On the holding member 51, a sheet trailing edge passage detection sensor PS2 and an actuator 53 are provided, and when the stapled package of sheets P is sent from the intermediate stacker 33 to the sheet exit roller unit 24, the actuator 53 is brought into contact with the upper surface of the package of sheets P, and the passage of the trailing edge of the package of sheets P is detected.

A rotary disk 54 which is rotated by a motor M5 through a gear train G, oscillates the holding member 51 through an arm member 55.

In the present invention, the driving means to drive the up-and-down sheet exit tray 60 is controlled so as to be changed corresponding to modes of finishing. That is, a mode in which the stapling of the package of sheets of a size not larger than a predetermined size, and not larger than a predetermined number of sheets, is conducted, (which is called the small size mode), and a mode in which the stapling of the package of sheets other than the above sheets, is conducted, (which is called the normal size common mode), are applied. The words of not larger than a predetermined size, mean, for example, the common mode of the size not larger than the A4-size, and for the words of not larger than a predetermined number of sheets, it is preferable that, for example, the number of sheets of not larger than 2 is applied.

The modes are set according to the sheet size information, set number of sheets information and stapling necessity information, obtained form the input from an operation section 91, or the automatic detection.

Figure 9:
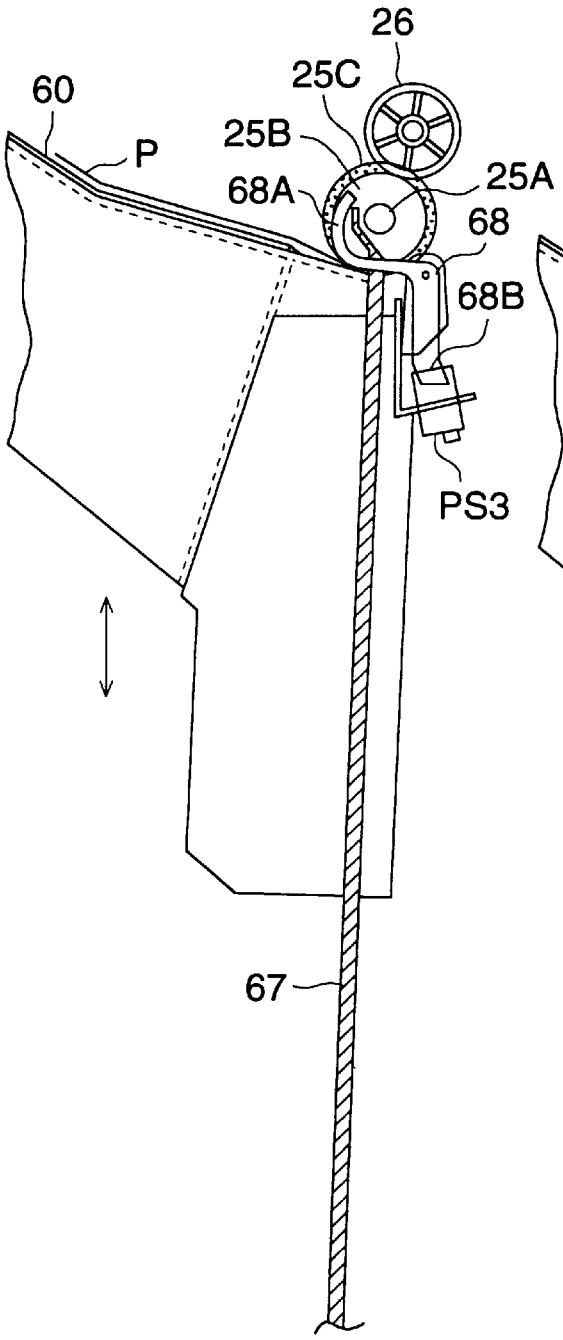
FIGS. 9(*a*) and 9(*b*) are sectional views showing an upper limit position of an up-and-down sheet exit tray at the time of a non-staple mode and a normal size mode in which stapling is conducted.
Figure 9:
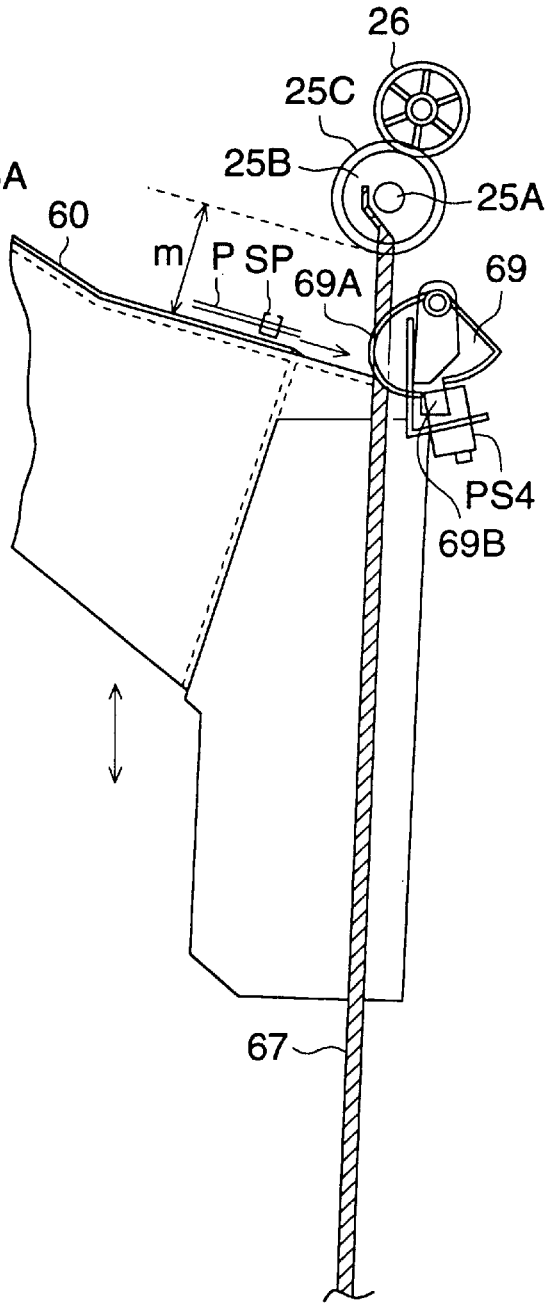

FIG. 9(*a*) is a sectional view showing an upper limit position of the up-and-down sheet exit tray 60 when stapling is not conducted (non-staple mode).

In the upper portion of a trailing edge reference member 67, a detecting means composed of a photo-interrupter type sheet exit tray upper limit sensor PS3 and an oscillatable actuator (detecting member) 68, is set. When the up-and-down sheet exit tray 60 is driven upward, and a leading edge portion 68A of the actuator 68 is brought into contact with the upper surface of the up-and-down sheet exit tray 60 or the upper surface of the sheets P stacked on the up-and-down sheet exit tray 60, a trailing edge portion 68B of the actuator 68 opens the light detection section of the sheet exit tray upper limit sensor PS3 and makes the sensor a switch-off condition, and stops the drive of the up-and-down sheet exit tray 60. The stop position of the up-and-down sheet exit tray 60 is a position at which the upper surface of the up-and-down sheet exit tray 60 or the upper surface of the sheet P stacked on the up-and-down sheet exit tray 60 comes into pressure-contact with the winding roller 25C at a predetermined pressure.

In this condition, the rotating winding roller 25C always comes into pressure-contact with the sheet P at a predetermined pressure and sends the sheet P into the trailing edge reference member 67, and aligns the trailing edge. According to the increase of the number of sheets P stacked on the up-and-down sheet exit tray 60, the up-and-down sheet exit tray 60 is driven downward, and the uppermost surface of the sheets P stacked on the up-and-down sheet exit tray 60 is detected and controlled by the exit tray upper limit sensor PS3 and the actuator 68, and the sheets P are always maintained at a predetermined upper surface height, and are brought into pressure-contact with the outer peripheral surface of the winding roller 25C at a predetermined pressure.

FIG. 9(*b*) is a sectional view showing the upper limit position of the up-and-down sheet exit tray 60 at the time of the normal size mode in which the stapling is conducted.

Below the first sheet exit tray upper limit sensor PS3 in the upper portion of a trailing edge reference member 67, a photo-interrupter type second sheet exit tray upper limit sensor PS4 and an oscillatable actuator 69, are set. When the up-and-down sheet exit tray 60 is driven upward, and a leading edge portion 69A of the actuator 69 is brought into contact with the upper surface of the stapled package of sheets P stacked on the up-and-down sheet exit tray 60, a trailing edge portion 69B of the actuator 69 opens the light detection section of the sheet exit tray upper limit sensor PS4 and makes the sensor a switch-off condition, and stops the drive of the up-and-down sheet exit tray 60.

The stop position of the up-and-down sheet exit tray 60 is a position at which the package of sheets P stacked on the up-and-down sheet exit tray 60 has an interval m at which it is not in contact with the winding roller 25C. In this condition, the package of sheets P delivered from the sheet exit roller unit 24 is placed on the up-and-down sheet exit tray 60, and the trailing edge of the package of sheets P enters below the winding roller 25C and is brought into contact with the trailing edge reference member 67, and stops.

The outer peripheral surface of the winding roller 25C and the upper surface of the up-and-down sheet exit tray 60 or the upper surface of the package of sheets P have the interval m between them, therefore, the staple wires SP pinned on the package of sheets P do not come into contact with the outer peripheral surface of the winding roller 25C and do not damage it.

As the increase of the number of the sets of sheets P stacked on the up-and-down sheet exit tray 60, the up-and-down sheet exit tray 60 is driven downward, and the uppermost surface of the sets of sheets P stacked on the up-and-down sheet exit tray 60 is detected and controlled by the sheet exit tray upper limit sensor PS4 and the actuator 69, and has always the constant interval m.

Figure 10:
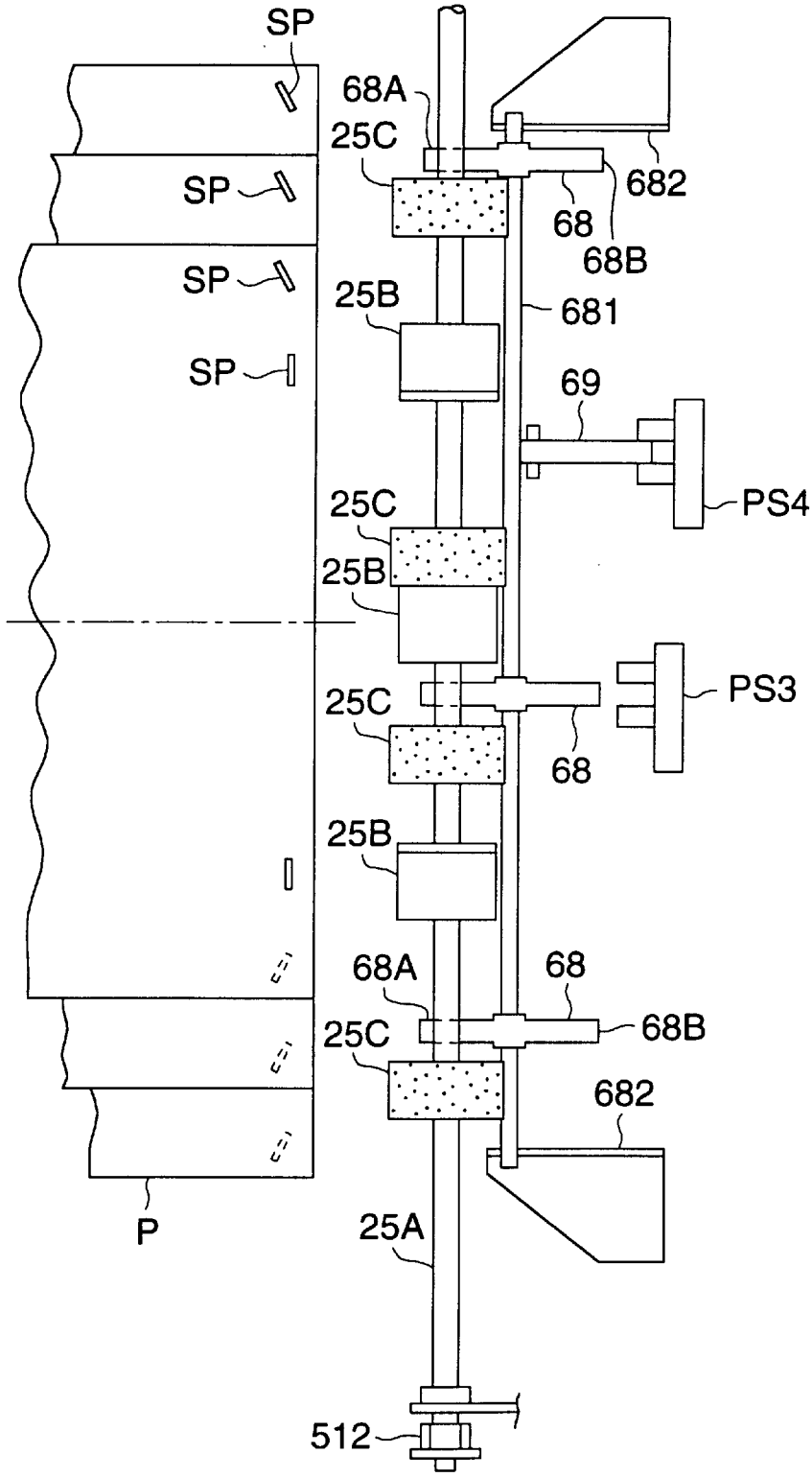
FIG. 10 is a plan view showing a main portion of the sheet delivery means of the finisher.

FIG. 10 is a plan view showing a main portion of a sheet delivery means of the finisher.

An oscillation shaft 681 integrated with the actuator 68 is oscillatably supported by a pair of left and right support plates 682 fixed on the casing of the finisher. A plurality of actuators 68 are arranged in the direction perpendicular to the conveyance direction of the sheet (3 actuators shown in the drawing). The leading edge portions 68A of the plurality of actuators have the same shape and arranged in the same phase, and are brought into light pressure-contacts with the upper surface of the up-and-down sheet exit tray 60 or the upper surface of the sheets P stacked on the up-and-down sheet exit tray 60.

The arrangement position of the actuators 68 in the width of the sheet is set in the vicinity of the position at which the staple wires SP are pinned onto the package of sheets P. The position onto which the staple wires SP are pinned, is one portion in the vicinity of either one end portion in the direction of the width of the package of sheets P, or two portions separated into equal intervals from the center in the direction of the width of the package of sheets P. Further, the position to be pinned by the staple wires is set at a position in the direction of the width of sheets P different due to the size of the sheet.

Figure 11:
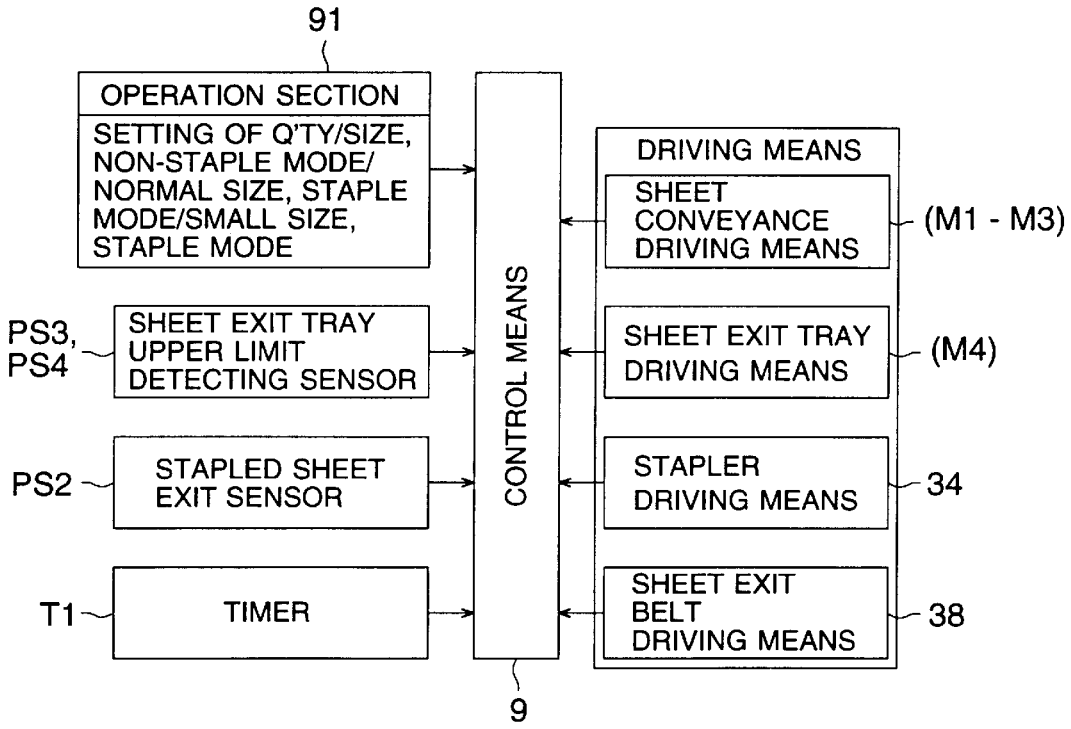
FIG. 11 is a block diagram showing the embodiment of the present invention.
Figure 12:
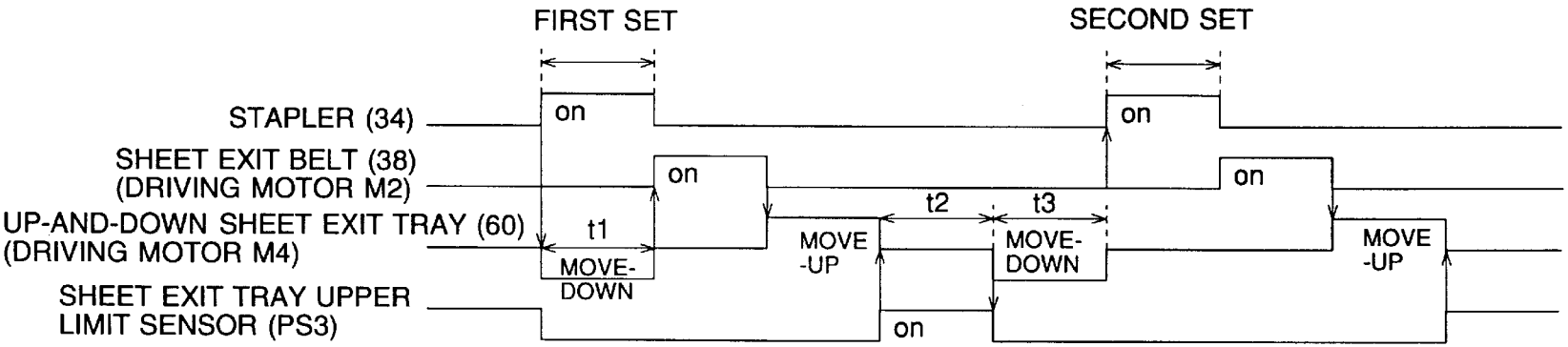
FIG. 12 is a timing chart showing the embodiment of the present invention.

Next, the embodiment of the present invention will be described referring to a black diagram in FIG. 11 and a timing chart in FIG. 12.

When the small size mode, in which small sized sheets (for example, B5 size, A4 size, 8.5×11 inches size, etc.) not larger than a predetermined number of sheets and not larger than a predetermined size, are stapled, is set, before the package of sheets P which is stapled by a stapler 34, is completed to be delivered onto the up-and-down sheet exit tray 60 the drive of the sheet delivery means, the control means temporarily withdraws the up-and-down sheet exit tray 60 from the upper limit detection position to detect the height position of the uppermost surface of the package of sheets P by the detecting means to the lower position, and after the delivery onto the up-and-down sheet exit tray 60 by the sheet delivery means has been completed and the drive of the sheet delivery means is stopped, moves up the up-and-down sheet exit tray 60, and stops it at the upper limit detection position. Exit operations of the package of sheets P will be detailed below.

(1) At the time of start of the stapling onto the first package of sheets P by the stapler 34, the driving motor M4 is driven and starts the lowering of the up-and-down sheet exit tray 60 from the initial position. By the lowering of the up-and-down sheet exit tray 60, the actuator 68 of the sheet exit tray upper limit sensor PS3 at the fixed position and the upper surface of the lowering up-and-down sheet exit tray 60 are separated, and when the actuator 68 is oscillated, the sheet exit tray upper limit sensor PS3 generates a signal and a timer T1 starts the time counting.

(2) After the passage of a predetermined setting time t1 (for example, 200 ms)by the timer T1, by a count-over signal of the timer T1, the control means stops the drive of the driving motor M4, and stops the up-and-down sheet exit tray 60 at a predetermined lowering position. This lowering stop position is a 5 to 6 mm lowered position from the initial position at which the upper surface of the up-and-down sheet exit tray 60 is in contact with the actuator 68.

(3) When the stapling onto the package of sheets P is completed, the driving motor M2 starts driving and rotates the exit belt 38, and presses the trailing edge of the package of sheets P by an exit claw of the exit belt 38, and delivers the package of sheets P towards the sheet exit roller unit 24. The sheet exit roller unit 24 nips the package of sheets P and delivers it onto the up-and-down sheet exit tray 60 positioned at the lowering position. The package of sheets P delivered onto the up-and-down sheet exit tray 60 slides down along the inclined surface of the up-and-down sheet exit tray 60, and the trailing edge of the package of sheets P comes into contact with the trailing edge reference member 67 and stops. At the lowering of the sheets, because the up-and-down sheet exit tray 60 is withdrawn to the lower portion, the staple wires by which the package of sheets is stapled, are not brought into contact with the sheet exit lower roller 25B and winding roller 25C, thereby, the sheet exit lower roller 25B and winding roller 25C are prevented from being damaged with the staple wires.

(4) When the home position sensor PS1 detects that the rotation of the exit belt 38 is completed and returned to the home position (initial position, HP), the control means 9 starts the drive of the driving motor M4 and moves the up-and-down sheet exit tray 60 upward. When the up-and-down sheet exit tray 60 is moved up and brought into contact with the actuator 68 and oscillates it, the sheet exit tray upper limit sensor PS3 is turned on, and the control means 9 generates a stop signal and stops the drive of the driving motor M4. By this stop of driving, the upward movement of the up-and-down sheet exit tray 60 is stopped.

(5) During the passage of a predetermined set time t2 (for example, 200 ms) from the stop signal, the drive of the driving motor M4 is topped and the sheet exit tray upper limit sensor PS3 maintains the on-status.

(6) According to the count-over signal of the set time t2 by the timer T1, the control means 9 re-starts the drive of the driving motor M4, moves the up-and-down sheet exit tray 60 downward, and stops it at a predetermined lowering position. By the start of lowering of the up-and-down sheet exit tray 60, the sheet exit tray upper limit sensor PS3 is turned off.

(7) After the passage of a predetermined set time t3 (for example, 200 ms) from the start of lowering of the up-and-down sheet exit tray 60, the stapling for the second package of sheets P is started. After that, in the same manner as the first package of sheets, the package of sheets is delivered and stacked.

Incidentally, in the above embodiments, the small size sheets P whose predetermined number of sheets is two, are accommodated in the path "h" of the third conveyance path 30 and registered by the conveyance roller 32, and these two sheets P are simultaneously delivered onto the intermediate stacker 33 and after these are double-sheet stapled by the stapler 34, these are delivered onto the up-and-down sheet exit tray 60 and stacked, however, the present invention is not limited to this double-sheet stapling, but may also be applied to the stapling and delivery of the package of sheets of a plurality of number of sheets whose predetermined number of sheets is not smaller than three.

For example, in addition to the paths "g2" and "g3" by the switching gates D2 and D3 shown in FIG. 2, when further, newly, a switching gate and a path are additionally provided, and a plurality of sheets are switched and controlled, the plurality of sheets are accommodated in the path "h", and by delivering them onto the up-and-down sheet exit tray 60 after stapling, the delivering time period between the sets of the small size sheets set is shortened, and these sets can be delivered at high speed and accommodated.

Further, in the embodiments of the present invention, the finisher connected to the copier main body which is represented as the image forming main body, is shown, however, the present invention can also be applied to the finisher which is used by being connected to the image forming apparatus such as a printer or a facsimile device, or a light printing machine.

According to the finisher of the present invention, when the small size sheets whose number of sheets are not larger than a predetermined number, and whose size is not larger than a predetermined size, are stapled, the shaving of the sheet exit lower roller or winding roller by the staple wires of the package of sheets can be prevented, the upper limit height detection control of the up-and-down sheet exit tray for each exit of one package of sheets is improved, the exit time period between sets of sheets can be shortened, and the high speed sheet exit onto the up-and-down sheet exit tray and accommodation can be attained.

What is claimed is:

1. A finisher comprising:

(a) a conveyance means for conveying sheets;

(b) an intermediate stacker on which conveyed sheets are stacked;

(c) a stapler for stapling a stacked package of sheets;

(d) a sheet delivery means for delivering the stapled package sheets or non-stapled sheets;

(e) an up-and-down sheet exit tray on which the delivered package of sheets is stacked and which can move up and down;

(f) a driving means for driving the up-and-down sheet exit tray;

(g) a first upper limit detector for detecting a first upper limit position of a surface of an uppermost non-stapled sheet which Is stacked on the up-and-down sheet exit tray where the surface of the uppermost non-stapled sheet is in contact with a plurality of lower rollers of the sheet delivery means;

(h) a second upper limit detector for detecting a second upper limit position, which is lower than the first upper limit position, of a surface of an uppermost stapled sheet which is stacked on the up-and-down sheet exit tray where the surface of the uppermost stapled sheet is spaced at a predetermined gap apart from the plurality of lower rollers; and (i) controller for controlling the driving means, wherein when a staple mode is selected, the controller drives the up-and-down sheet exit tray to temporarily move to the second upper limit position, and when the sheet delivery means finishes delivering the stapled package of sheets, the controller drives the up-and-down sheet exit tray to move up to the second upper limit position for the surface of the uppermost stapled sheet so that the predetermined gap is maintained.

2. The finisher of claim 1, wherein the sheet delivery means comprises a lower roller unit and an upper roller unit, the plurality of lower roller mounted on a rotation shaft of the lower roller unit comprise a sheet exit lower roller which faces a sheet exit upper roller mounted on a rotation shaft of the upper roller unit, and a flexible winding roller having an outer diameter greater than that of the sheet exit lower roller, for aligning the sheet on the sheet exit tray by coming into pressure contact with a trailing edge of the sheet.

3. The finisher of claim 1 wherein the second upper limit position is determined according to information of a number of the stapled package of sheets to be delivered by the sheet delivery means.

4. An image forming apparatus including a finisher, the finisher comprising:

(a) a conveyance means for conveying sheets, (b) an intermediate stacker on which conveyed sheets are stacked;

(c) a stapler for stapling a stacked package of sheets;

(d) a sheet delivery means for delivering the stapled package of sheets or non-stapled sheets;

(e) an up-and-down sheet exit tray on which the delivered package of sheets is stacked and which can move up and down;

(f) a driving means for driving the up-and-down sheet exit tray;

(g) a first upper limit detector for detecting a first upper limit position of a surface of an uppermost non-stapled sheet which is stacked on the up-and-down sheet exit tray where the surface of the uppermost non-stapled sheet is in contact with a plurality of lower rollers of the sheet delivery means;

(h) a second upper limit detector for detecting a second upper limit position, which is lower than the first upper limit position, of a surface of an uppermost stapled sheet which is stacked on the up-and-down sheet exit tray where the surface of the uppermost stapled sheet is spaced at a predetermined gap apart from the plurality of lower rollers; and (i) a controller for controlling the driving means, wherein when a staple mode is selected, the controller drives the up-and-down sheet exit tray to temporarily move to the second upper limit position, and when the sheet delivery means finishes delivering the stapled package of sheets, the controller drives the up-and-down sheet exit tray to move up to the second upper limit position for the surface of the uppermost stapled sheet so that the predetermined gap is maintained.

* * * * *